United States Patent [19]

Klöcker

[11] Patent Number: 4,609,015

[45] Date of Patent: Sep. 2, 1986

[54] DEVICE FOR PRODUCING A FABRIC EDGE PROVIDED WITH A BINDING (WHIP EDGE)

[76] Inventor: Heinz Klöcker, Wallenheckenstr. 2, 4280 Borken/Westf. 3, Fed. Rep. of Germany

[21] Appl. No.: 658,393

[22] Filed: Oct. 5, 1984

[30] Foreign Application Priority Data

Oct. 7, 1983 [DE] Fed. Rep. of Germany ..... 3336538
Mar. 23, 1984 [DE] Fed. Rep. of Germany ..... 3410754

[51] Int. Cl.[4] ..... D03C 11/00
[52] U.S. Cl. ..... 139/54
[58] Field of Search ..... 139/429, 54

[56] References Cited

U.S. PATENT DOCUMENTS 691,204 1/1902 Sutcliffe ..... 139/54
3,280,852 10/1966 Reitzler ..... 139/54

FOREIGN PATENT DOCUMENTS 116434 12/1900 Fed. Rep. of Germany ..... 139/54
330249 6/1903 France ..... 139/54

*Primary Examiner*—Henry S. Jaudon
*Attorney, Agent, or Firm*—Roberts, Spiecens & Cohen

[57] ABSTRACT

A device for producing a fabric edge provided with a binding comprising alternately movable harnesses, each carrying a plurality of warp thread holders for one group of warp threads. The holders have ends in one end position of the harnesses which are spaced at a distance apart in the direction of lift in order to form a shed. A guide mechanism moves the warp threads associated with one group laterally away and a binding thread holder for a binding thread binds the warped threads together. The binding thread holder has an end which is movable transversely in the shed. The guide mechanism is in the form of guide bars arranged parallel to each other between two frame rails fastened to the associated harness.

11 Claims, 5 Drawing Figures

DEVICE FOR PRODUCING A FABRIC EDGE PROVIDED WITH A BINDING (WHIP EDGE)

FIELD OF THE INVENTION

The present invention relates a device for producing a fabric edge provided with a binding in which alternately movable harnesses are provided.

DESCRIPTION OF PRIOR ART

Known are looms which operate without conventional shuttles. In such shuttle-less looms the insertion of the filling thread is effected by air. This means that at the edge of the fabric no binding takes place between the filling thread and the warp thread. The fabric selvage therefore tends to unravel. In order to prevent the unraveling, the edge must be bound in place. This is done by a device by which a so-called whip edge is created which prevents the fabric from unraveling at the edge.

Devices for the production of a whip edge are known in which a plurality of upwardly and downwardly moved standard threads are bound with a plurality of whip threads in the manner that the whip threads are pulled through oblique slots in a rail moved in the direction of lift so that upon the corresponding lifting movement of the rail the whip threads in each case assume the end position in the slot and thereby carry out an axial movement which leads to the whip threads being wound alternately around the standard threads.

If in this case two whip threads are used, then the binding of the edge of the fabric is too weak to satisfy all requirements. Therefore, as a rule, four whip threads are necessary in order to obtain a sufficiently firm fabric edge. If, however, four whip threads are used then the fabric edge stands out because it becomes thicker. This is undesired.

SUMMARY OF THE INVENTION

An object of the present invention is, therefore, to provide a device for the manufacture of a fabric edge provided with a binding in connection with which a sufficiently firm fabric edge can be obtained with a thread for the binding of the warp threads of a fabric which are located at the edge.

In accordance with the invention, the device is characterized by the fact that on each harness there are provided a plurality of warp thread holders for one group of warp threads each, the ends of which in one end position of the harnesses are at a distance apart in the direction of travel so as to form a shed, guide means are provided for the lateral moving away of the warp threads associated with one group of warp threads and a binding thread holder is provided for the binding thread which binds the warp threads together, said binding thread holder being arranged to be movable transverse to the shed.

With this construction, the warp threads which lie at the edge of the fabric are bound together by a warp thread which also serves as a binding thread in the manner that the warp thread is inserted like a filling thread in the region of the shed.

In accordance with one embodiment, the device can be constructed in the manner that the warp thread holders are needles which at their end have an opening (eye) for the holding of the warp thread. The binding thread holder is fastened to the one harness and consists of a swingable needle whose opening arranged at its end extends into the shed for the holding of the binding thread when the shed is formed.

In accordance with a preferred embodiment, the warp thread holders arranged on the one harness are formed as heddles for the one group of warp threads, a plurality of warp thread holders for the other group of warp threads being provided on the other harness and one or more guide means producing a slot for the warp threads of the one group of warp threads being arranged on said harness.

In this embodiment, the heddles which are already present in looms are used also as warp thread holders.

With this construction, three warp threads, for example, are passed through the eyes of the heddles which are fastened to the one harness and two warp threads are passed through the eyes of the needles of the warp thread holders which are fastened to the other harness. In this case also the result is obtained that, with a given position of the harness, the formation of a shed is brought about since the thread guide means (eyes) for the corresponding groups of warp threads are at a distance from each other.

The warp thread holders of the other group of warp threads are arranged on a frame which is fastened to the other harness. The frame consists in this connection of two parallel frame rails.

In order to assure the free mobility of the binding-thread holder upon the formation of the shed, the one group of warp threads must be moved to the side since otherwise these warp threads would be in the way of the transverse movement of the binding-thread holder. For this purpose, guide means are provided. The guide means for the lateral moving away of the warp threads of this group of warp threads consist, in each case, of an opening arranged on the frame rails and of a deflection device arranged on the frame.

The guide means fastened to the harness which produce one or more slots are developed essentially in the form of parallel bars so that a slot remains between the bars through which the warp threads of the one group of warp threads are passed. These guide means have the task of reliably guiding the warp threads which are conducted through the eyes of the heddles which themselves tend to flutter, and in particular of preventing individual warp threads from carrying out, at the considerable operating speeds, uncontrolled movements which could lead to a disturbance in the binding of the fabric edge.

In order that the binding thread holder does not produce any disturbance of the warp threads when it is in its position of rest and therefore when the harnesses are carrying out their lift motion, the binding thread holder in its position of rest is displaceable parallel to the central position. In this way, the result is obtained that upon the lift movement of the harnesses, the binding thread holder assumes the position in which it is parallel to the direction of lift. In the simplest case, this can be achieved in the manner that, for instance, a swingable binding thread holder is made of flexible material so that in its position of rest it finds a support by which it lies parallel to the direction of lift as a result of its possibility of bending.

In detail, the construction can be such that the guide means, in the form of bars, are arranged between two frame rails which are fastened to the one harness, the frame rails at the same time bearing the needles with terminal eyes developed as warp thread holders, in which connection the binding thread holder is movable between the frame rails and the one frame rail in each case represents the stop for the binding thread holder.

BRIEF DESCRIPTION OF THE FIGURES OF THE DRAWING

One illustrative embodiment is shown in the drawing, in which:

in FIG. 2 and

DETAILED DESCRIPTION OF PREFERRED EMBODIMENTS

Figure 1:
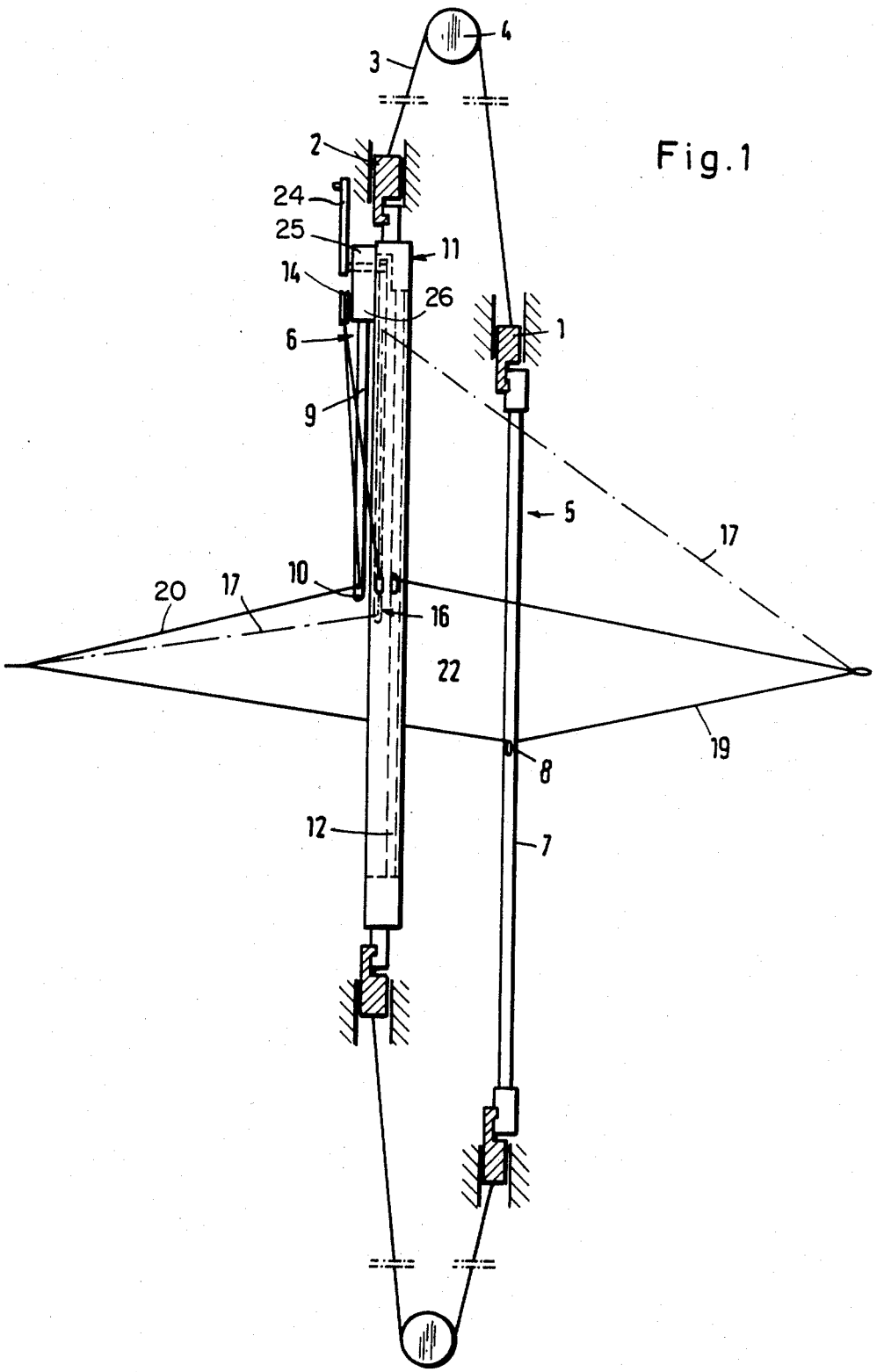
FIG. 1 shows the device of the invention developed with heddles, seen from the side.

As can be noted, in particular, from FIG. 1, the device for the formation of a fabric edge provided with a binding consists of alternately moved harnesses 1 and 2, the harnesses being alternately movable by means of a connecting means 3 which is guided over a roller 4, as is known per se.

On the harness 1 there are arranged a plurality of warp thread holders 5 for one group of warp threads; on the harness 2 the other warp thread holders 6 for the other group of warp threads are arranged.

In detail, the warp thread holders 5 consist of three heddles 7 with eyes 8; the other warp thread holders 6 consist of the needles 9 with terminal eyes 10.

Figure 2:
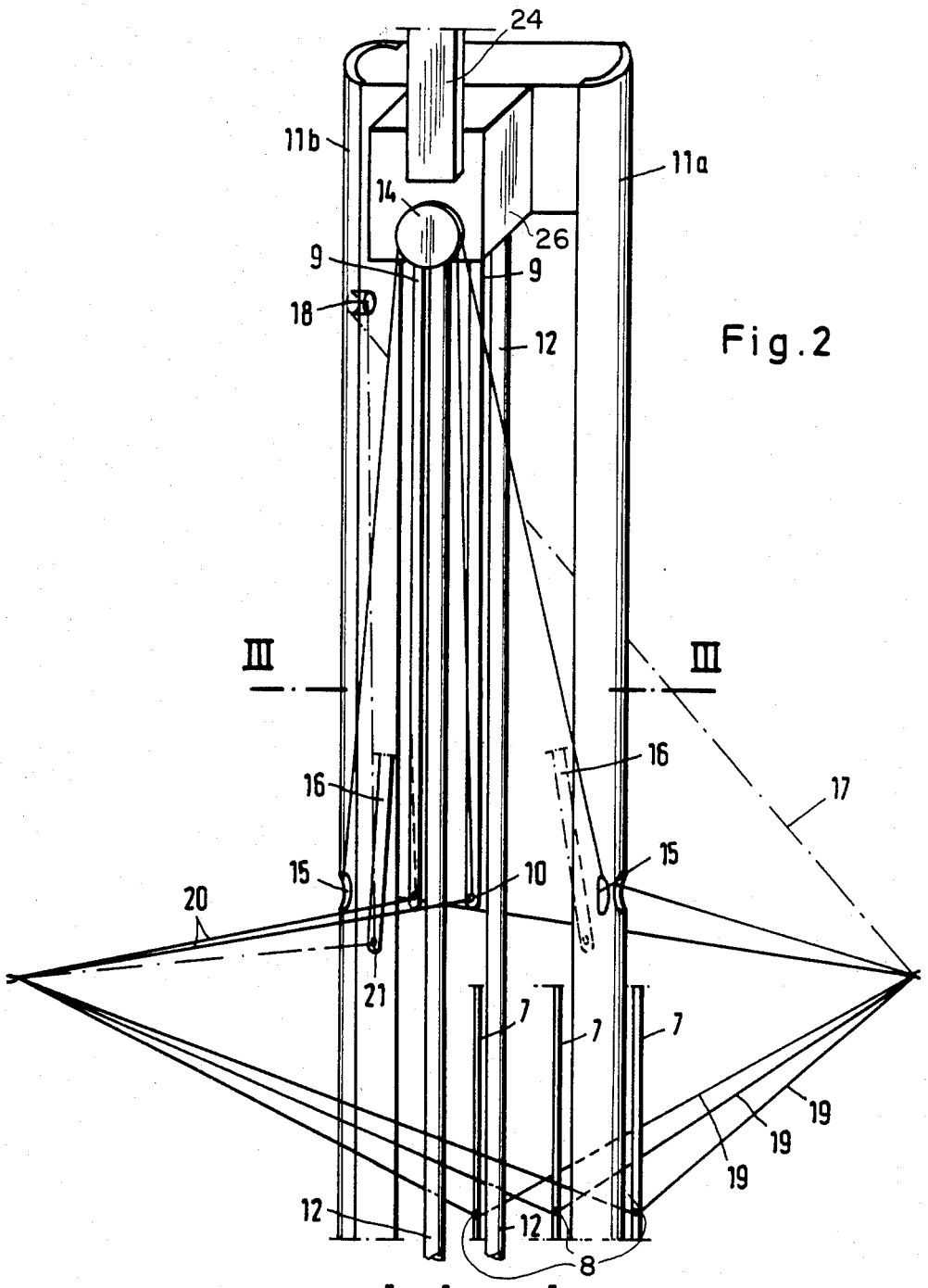
FIG. 2 is a perspective view of the warp thread holders arranged on a harness together with the guide means, as well as the binding thread holder and parts of the heddles.
Figure 3:
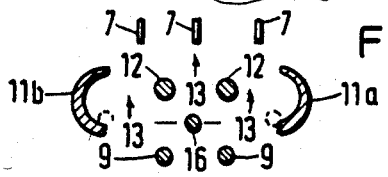
FIG. 3 is a section taken along the line III—III.

The warp thread holder 6 is arranged on the harness 2 by means of a frame 11 which consists of two frame rails 11*a* and 11*b* (FIG. 2). Between the frame rails 11*a* and 11*b* are guide means for the warp threads 19 which are passed through the heddles 7. The guide means comprises guide bars 12 so that in each case there is a slot 13 between the guide bars 12 (FIG. 3). In this way, the warp threads 19 which are conducted through the eyes 8 of the heddles 7 can be introduced into the slots 13. These slots and guide means assure the dependable guidance of the warp threads passed through the heddles, in particular in view of the fact that the heddles are made of thin strips of sheet metal which tend to flutter at higher speeds of operation.

The warp threads 20 conducted through the eyes 10 of the needles 9 are moved towards the side. This is done in the manner that the warp threads which are passed through the eyes 10 are first of all guided upward over a roller 14 and then moved out laterally from an opening 15 in the frame rail 11*a* or 11*b* respectively. In this way the result is obtained that when the eyes 8 are at a distance from the eyes 10, and a shed is thus formed, the inside of the shed is free, so that the binding thread holder 16 which is arranged on the harness or the frame 11 and is also constructed in the form of a needle with a terminal eye 21 is freely movable in the shed through the opening.

The binding thread holder 16 is swingable between the frame rails 11*a* and 11*b* by rotating with a pivot 25 in a support block 26 on frame 11 under the action of an actuating arm 24.

In its position of rest, the binding thread holder 16 strikes against one frame rail 11*a* or 11*b* respectively. In order that this binding thread holder can assume an approximately parallel position with respect to its central position, the binding thread holder 16 is made of flexible material. Upon striking against the frame rail, the binding thread holder therefore bends in such a manner that it then lies practically parallel to the direction of movement of the harnesses (not shown). In this position of rest of the binding thread holder 16, disturbance of the warp threads by the binding thread holder cannot take place upon movement of the harnesses.

In FIG. 2, the binding thread 17 has been shown for the sake of greater clarity in dash-dot lines, as is the warp thread which is guided through an opening 18 in the frame rail 11*b* and then travels through the eye 21 of the binding thread holder 16.

The manner of operation of the device is as follows:

When the harnesses have reached a given position, the eyes 8 of the heddles 7 and the eyes 10 of the needles 9 are a certain distance apart, the corresponding groups of warp threads which are passed through the eyes forming a shed 22. In this position, the shed is open so that the transverse movement of the binding thread holder 16 can take place, the holder 16 having the eye 21 at its end through which the binding thread 17 is guided. The binding thread is thus inserted in the manner of a filling thread, in which connection at the same time the introduction of the filling thread takes place also in this position of the shed, whereupon the customary beating-up of the filling thread, and thus also of the binding thread, takes place by known means.

When the binding thread 17 has been inserted in this way into the shed 22, the binding thread holder, as a result of its possibility of bending, lies against the frame rail 11*a* or 11*b* respectively which serves as a stop, so that the binding thread holder lies substantially parallel to the direction of travel of the harnesses. The harnesses 1 and 2 are then moved in such a manner that the warp thread holders 6 are moved, for instance, downward and the heddles 7 upward. In this case, the ends of the warp thread holders, i.e. of the eyes 10 and 8, overlap, so that in this position movement of the binding thread holder is not possible. Only when, after the reversal of movement of the harnesses, a shed is again formed, is the insertion of a binding thread possible in the manner described above.

As can be noted in particular from FIG. 3, the binding thread holder 16 lies between the guide bars 12 and the needles 9.

Figure 4:
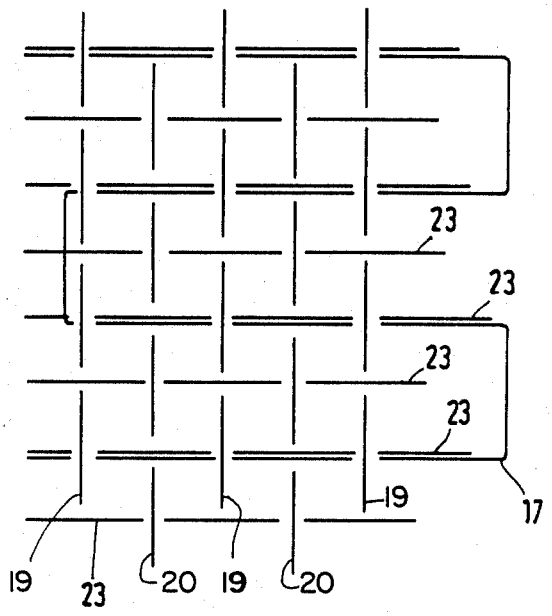
FIG. 4 shows the binding pattern of the binding thread, filling thread and warp threads
Figure 5:
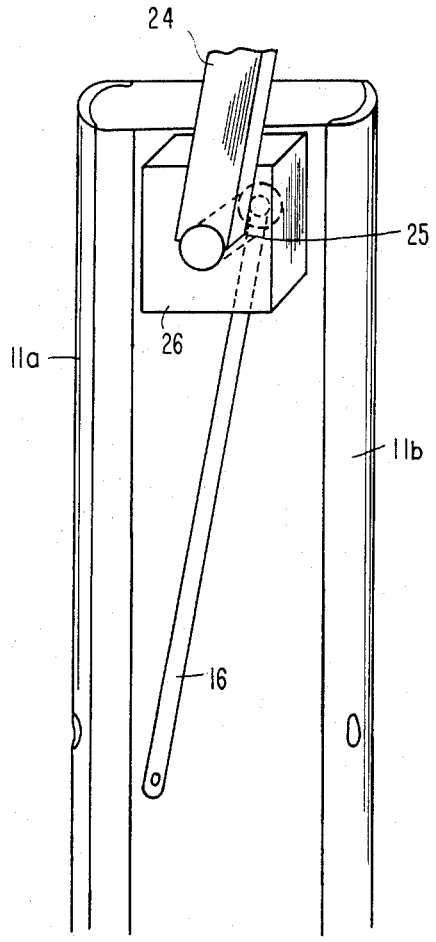
FIG. 5 is a view of a portion of the apparatus in FIG. 2.

FIG. 4 shows the binding pattern of the binding thread, filling thread and warp threads. The filling thread is designated 23 while the binder thread is designated 17. It can be seen that in each case alternatively, on the one hand, the filling thread lies alone in the shed and then both threads, namely filling thread and binding thread, lie in the shed.

I claim:

1. A device for producing a fabric edge provided with a binding thread comprising two harnesses movable in opposite directions along opposed paths of travel between respective end positions, a plurality of warp thread holders on each harness for a respective group of warp threads, said holders having ends with means for guiding the respective warp threads, said ends of the holders on the respective harnesses being spaced apart in the direction of travel of the harnesses in one of said end positions thereof to form a shed from said warp threads, guide means associated with one of said harnesses for guiding the respective group of warp threads laterally away from the respective holders on said one harness to form an opening in the shed, and a binding thread holder for a binding thread which is to bind the warp threads together, said binding thread holder having an end at which the binding thread is guided, said binding thread holder being movable on said one harness through said opening in the shed to move said end of the binding thread holder, along with said binding thread thereat, transversely in the shed.

2. A device according to claim 1, wherein the warp thread holders include needles, said means at the ends of the holders being openings for guidably holding the warp thread.

3. A device according to claim 1, wherein the binding thread holder comprises a swingable needle having an opening, arranged at said end, which extends into the shed in order to insert the binding thread in the shed.

4. A device according to claim 1 wherein the warp thread holders on the other of said harnesses comprise heddles and comprising a further guide means producing a slot for the warp threads on said other harness.

5. A device according to claim 4, comprising a frame on said one harness including two parallel frame rails.

6. A device according to claim 5, wherein said guide means for guiding the warp threads associated with said one harness is constituted by an opening in the frame rails and a deflection device on the frame.

7. A device according to claim 5 wherein the further guide means comprises guide bars arranged parallel to one another between said frame rails.

8. A device according to claim 7 wherein the warp thread holders on said one harness comprise needles and the means for guiding the respective warp threads are terminal eyes in said needles, said needles being arranged on said two parallel frame rails, said guide bars being disposed between the frame rails, said binding thread holder being movable transversely in front of the guide bars.

9. A device according to claim 4 wherein said binding thread holder has a position of rest displaced substantially parallel to its central position.

10. A device according to claim 7 wherein said binding thread holder is made of flexible material.

11. A device according to claim 1 wherein said binding thread holder is swingably movable on said one harness.

* * * * *